US009144973B2

(12) United States Patent
Cruz-Uribe et al.

(10) Patent No.: US 9,144,973 B2
(45) Date of Patent: Sep. 29, 2015

(54) PIEZOELECTRIC INKJET DIE STACK

(75) Inventors: Tony S. Cruz-Uribe, Corvallis, OR (US); James E. Clark, Corvallis, OR (US); Peter James Fricke, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/374,774

(22) PCT Filed: Apr. 29, 2012

(86) PCT No.: PCT/US2012/035719
§ 371 (c)(1),
(2), (4) Date: Jul. 25, 2014

(87) PCT Pub. No.: WO2013/165335
PCT Pub. Date: Nov. 7, 2013

(65) Prior Publication Data
US 2015/0202871 A1 Jul. 23, 2015

(51) Int. Cl.
*B41J 2/14* (2006.01)
*B41J 2/16* (2006.01)

(52) U.S. Cl.
CPC ..... *B41J 2/14201* (2013.01)

(58) Field of Classification Search
CPC ..... B41J 2/14072; B41J 2/14201; B41J 2/14233; B41J 2/17526; B41J 2002/14491
See application file for complete search history.

(56) References Cited

U.S. PATENT DOCUMENTS

| | | | | |
|---|---|---|---|---|
| 6,412,928 | B1 | 7/2002 | Anagnostopoulos et al. | |
| 6,955,419 | B2 * | 10/2005 | Andrews et al. | 347/70 |
| 7,255,425 | B2 | 8/2007 | Lai et al. | |
| 7,506,965 | B2 | 3/2009 | Silverbrook | |
| 7,686,423 | B2 * | 3/2010 | Sato et al. | 347/50 |
| 7,980,676 | B2 * | 7/2011 | Hirosawa et al. | 347/65 |
| 2007/0165081 | A1 | 7/2007 | Shiki | |
| 2009/0273643 | A1 | 11/2009 | Silverbrook | |

FOREIGN PATENT DOCUMENTS

| | | |
|---|---|---|
| JP | 2008213296 A | 9/2008 |
| JP | 2012061716 | 3/2012 |

(Continued)

OTHER PUBLICATIONS

International Search Report and Written Opinion dated Dec. 26, 2012, issued on PCT Patent Application No. PCT/US2012/035719 dated Apr. 29, 2012, Korean Intellectual Property Office.

(Continued)

*Primary Examiner* — Juanita D Jackson
(74) *Attorney, Agent, or Firm* — Kacvinsky Daisak PLLC

(57) ABSTRACT

A piezoelectric inkjet die stack includes a printhead substrate die, a pedestal seated on the printhead substrate die, a fluidics die seated atop the pedestal, and integrated circuit (IC) dies seated on the printhead substrate die. The IC dies may be positioned substantially but not completely beneath the fluidics die and positioned on either side of the pedestal such that air gaps exist between a top surface of each IC die and a bottom surface of the fluidics die and between each IC die and the pedestal. The pedestal may include ink flow channels to allow ink flow between the fluidics die and the printhead substrate. A plurality of stand-offs may be implemented to help support the fluidics die above the IC dies.

20 Claims, 7 Drawing Sheets

(56) References Cited

FOREIGN PATENT DOCUMENTS

| | | | |
|---|---|---|---|
| KR | 20090003802 | A | 1/2009 |
| WO | WO-2011/043776 | A1 | 4/2011 |

OTHER PUBLICATIONS

Murata et al., High-Resolution Piezo Inkjet Printhead Fabricated by Three Dimensional Electrical Connection Method Using Through Glass via, Jan. 25-29, 2009, pp. 507-510, IEEE.

* cited by examiner

100

700

1000

PIEZOELECTRIC INKJET DIE STACK

CLAIM FOR PRIORITY

The present application is a national stage filing under 35 U.S.C 371 of PCT application number PCT/US2012/035719, having an international filing date of Apr. 29, 2012, the disclosure of which is hereby incorporated by reference in its entirety.

BACKGROUND

The two most common drop-on-demand inkjet printers use inkjet printheads categorized according to one of two mechanisms of drop formation. Thermal bubble inkjet printers use thermal inkjet (TIJ) printheads with heating element actuators that vaporize ink (or other fluid) inside ink-filled chambers to create bubbles that force ink droplets out of the printhead nozzles. Piezoelectric inkjet printers use piezoelectric inkjet (PIJ) printheads with piezoelectric ceramic actuators that change shape to generate pressure pulses inside ink-filled chambers to force droplets of ink (or other fluid) out of the printhead nozzles.

Piezoelectric inkjet printheads are favored over thermal inkjet printheads when using jettable fluids whose higher viscosity and/or chemical composition prohibit the use of thermal inkjet printheads, such as UV curable printing inks. Thermal inkjet printheads are limited to jettable fluids whose formulations can withstand boiling temperature without experiencing mechanical or chemical degradation. Because piezoelectric printheads use electromechanical displacement (not steam bubbles) to create pressure that forces ink droplets out of nozzles, piezoelectric printheads can accommodate a wider selection of jettable materials. Accordingly, piezoelectric printheads are utilized to print on a wider variety of media.

Piezoelectric inkjet printheads are commonly formed of multilayer stacks. Ongoing efforts to improve piezoelectric inkjet printheads involve reducing fabrication and material costs of each layer in the stacks while improving the printheads' performance, size and robustness.

SUMMARY

A piezoelectric inkjet die stack includes a printhead substrate die, a pedestal seated on the printhead substrate die, a fluidics die seated atop the pedestal, and integrated circuit (IC) dies seated on the printhead substrate die. The IC dies may be positioned substantially but not completely beneath the fluidics die and positioned on either side of the pedestal such that air gaps exist between a top surface of each IC die and a bottom surface of the fluidics die and between each IC die and the pedestal. The pedestal may include ink flow channels to allow ink flow between the fluidics die and the printhead substrate. A plurality of stand-offs may be implemented to help support the fluidics die above the IC dies.

DETAILED DESCRIPTION

Figure 1:
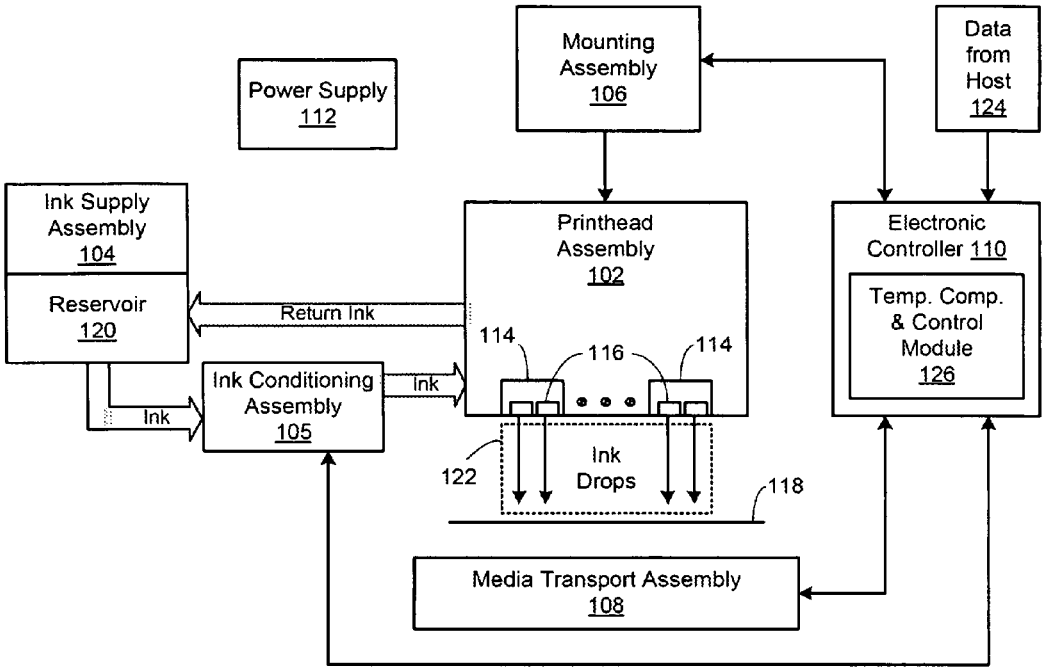
FIG. 1 shows a fluid ejection device embodied as an inkjet printing system suitable for incorporating a fluid ejection assembly having a piezoelectric die stack as disclosed herein, according to an embodiment.

In referencing the figures, like components utilize like reference numbers throughout the disclosure. As noted above, improving PIJ printheads can involve developing cheaper, more compact, higher performing and more robust stacks. As part of this ongoing trend, multiple silicon die are increasingly used for many of the layers in the stack since finer, more densely packed features can be etched into silicon. Stack layers may be comprised of silicon, certain metals, polymers, or ceramics. Various issues in the development of silicon die stacks include the proper vertical alignment of features such as manifold compliances, drive electronics, and multiple ink feeds to the pressure chambers. Other issues include reducing the length and improving the yield of electrical interconnections between die and external signal cables. Reducing the high cost of certain die in the stack is an ongoing challenge.

Previous attempts to improve PIJ printheads include the use of die stack designs having wire bonds attached to die backsides, die slots for passing drive wires between die layers, fluidics routed around rather than through die layers, variously-shaped and same-shaped die within the die stack, and control circuit die that are near but not integrated into the die stack.

Embodiments of the present disclosure address these issues through a piezoelectric drop ejector (printhead) that includes a multilayer micro mechanical electrical system (MEMS) die stack having a thin film piezoelectric actuator and drive circuitry. The MEMS stack includes a printhead substrate die layer, an IC die layer and a fluidics die layer stacked substantially vertically. The IC die layer may include multiple IC dies. Similarly, the fluidics layer may include multiple fluidics dies. The IC dies include control circuitry (e.g., an ASIC) to control piezo-actuator drive transistors.

The embodiments described herein also disclose a pedestal component that sits atop the printhead substrate die. The pedestal component rises a distance that is slightly higher than the height of the IC dies. The fluidics die layer sits atop the pedestal component. This creates a volume beneath the fluidics die layer and above the printhead substrate die. In this arrangement, the IC dies rest on the printhead substrate die and may be substantially positioned beneath the fluidics die layer. A vertical air gap may be formed between the IC dies and the pedestal component as well as between the IC dies and the fluidics die layer to avoid heat transfer that could adversely affect the performance of the PIJ drop ejectors. The pedestal component is sufficiently wide to allow for ink flow channels that can carry ink between the fluidics die layer and the printhead substrate die.

Signals, power, and ground returns may reach each of the IC dies using a flex cable from the printhead to one of the IC dies. IC routing may be achieved using wire bonds that navigate around the pedestal and fluidics die layer or via traces along the outer edges of one of the fluidics dies. The arrangement of the IC dies apart from the fluidics die layer removes constraints on the IC dies. For instance, the IC dies need not include ink flow channels because they have been relocated to within the pedestal. This arrangement may also reduce the area needed for the IC dies thereby improving the functionality, reliability, and the cost associated with the PIJ printhead.

In one embodiment, a PIJ die stack includes a printhead substrate die, multiple IC dies stacked on the substrate die, and a fluidics die layer stacked above the multiple IC dies. A pedestal component sits atop the printhead substrate die and separates two of the IC dies. The IC dies do not touch the pedestal as an air gap is maintained to prevent heat transfer between components. The pedestal component rises slightly above the height of the IC dies and includes ink flow channels for transporting ink from the printhead substrate die to the fluidics die layer and back. The fluidics die layer sits atop the pedestal component but does not touch the IC dies. A horizontal air gap separates the fluidics die layer and the IC dies. To provide an additional measure of stability, a plurality of stand-offs help support the fluidics die layer above the IC dies. The, size and arrangement of the stand-offs may vary from embodiment to embodiment. The IC dies may then be positioned beneath the fluidics die layer without the disadvantages associated with running ink passageways throughout the IC dies.

FIG. 1 illustrates a fluid ejection device embodied as an inkjet printing system 100 suitable for incorporating a fluid ejection assembly (i.e., printhead) having a silicon die stack as disclosed herein, according to an embodiment of the disclosure. In this embodiment, a fluid ejection assembly is disclosed as a fluid drop jetting printhead 114. Inkjet printing system 100 includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. Inkjet printhead assembly 102 includes at least one fluid ejection assembly 114 (printhead 114) that ejects drops of ink through a plurality of orifices or nozzles 116 toward a print medium 118 so as to print onto print media 118. Print media 118 can be any type of suitable sheet or roll material, such as paper, card stock, transparencies, polyester, plywood, foam board, fabric, canvas, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one embodiment, ink supply assembly 104 supplies ink under positive pressure through an ink conditioning assembly 105 to inkjet printhead assembly 102 via an interface connection, such as a supply tube. Ink supply assembly 104 includes, for example, a reservoir, pumps and pressure regulators. Conditioning in the ink conditioning assembly 105 may include filtering, pre-heating, pressure surge absorption, and degassing. Ink is drawn under negative pressure from the printhead assembly 102 to the ink supply assembly 104. The pressure difference between the inlet and outlet to the printhead assembly 102 is selected to achieve the correct backpressure at the nozzles 116, and is usually a negative pressure between negative 1" and negative 10" of $H_2O$. Reservoir 120 of ink supply assembly 104 may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one embodiment, inkjet printhead assembly 102 is a scanning type printhead assembly. As such, mounting assembly 106 includes a carriage for moving inkjet printhead assembly 102 relative to media transport assembly 108 to scan print media 118. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

Electronic printer controller 110 typically includes a processor, firmware, software, one or more memory components including volatile and non-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic printer controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters from data 124. In one embodiment, electronic controller 110 includes temperature compensation and control module 126 stored in a memory of controller 110. Temperature compensation and control module 126 executes on electronic controller 110 (i.e., a processor of controller 110) and specifies the temperature that circuitry in the MEMS die stack maintains for printing. Temperature in the die stack is controlled locally by on-die circuitry that includes temperature sensing resistors and heater elements in the pressure chambers of fluid ejection assemblies (i.e., printheads) 114. More specifically, controller 110 executes instructions from module 126 to sense and maintain ink temperatures within pressure chambers through control of temperature sensing resistors and heater elements on a circuit die adjacent to the chambers.

Figure 2:
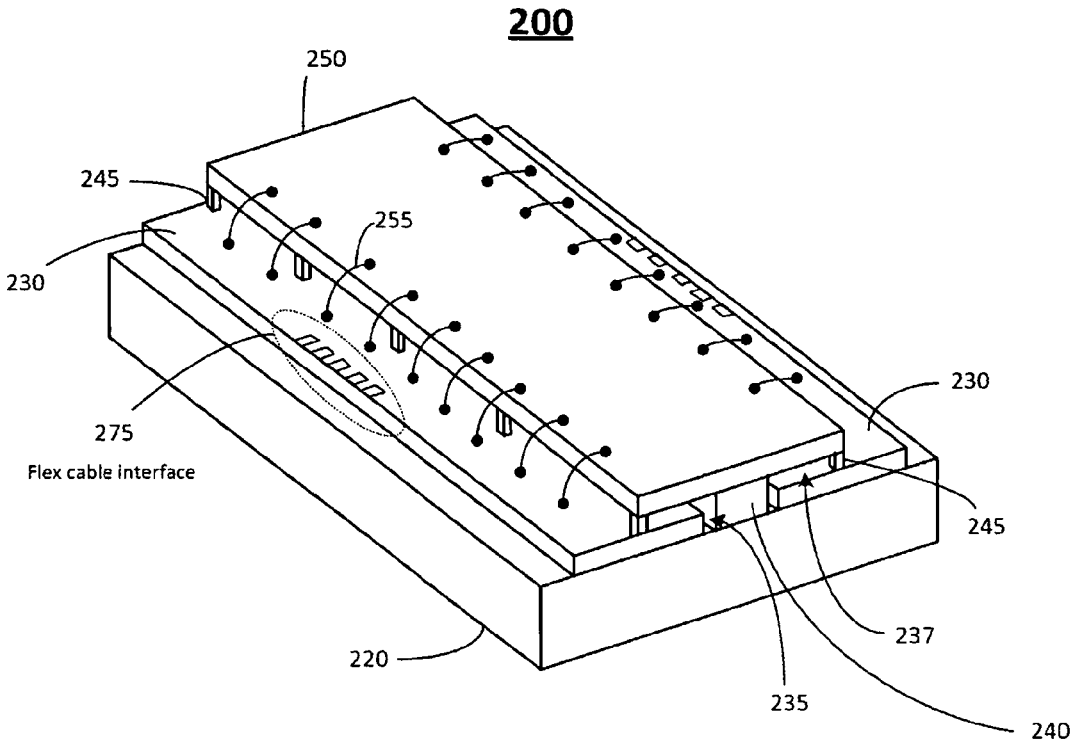
FIG. 2 shows a perspective view of an example piezoelectric die stack in a PIJ printhead, according to an embodiment.

FIG. 2 shows a perspective view of an example piezoelectric die stack 200 in a PIJ printhead 114, according to an embodiment of the disclosure. In general, the PIJ printhead 114 may include multiple die layers, each with different functionality. The layers in the die stack 200 may include a polymer printhead substrate die 220 layer, an IC die layer comprised of one or more IC dies 230, and a fluidics die 250 layer. Each layer in the die stack 200 may be formed of silicon, but stainless steel and polyimide are common. The layers may be bonded together using a chemically inert adhesive such as epoxy (not shown). A pedestal component 240 may set atop the printed substrate die 220. The pedestal component 240 may be molded into the polymer printhead substrate die 220 or may be a separate plastic, stainless steel or silicon part that is similarly adhered to the printhead substrate die 220. The embodiments are not limited to these examples.

Figure 3:
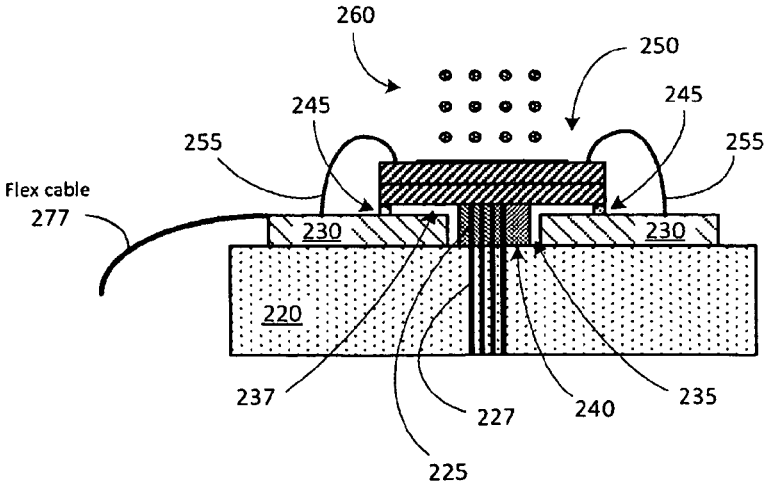
FIG. 3 shows a cross-sectional side view of the example piezoelectric die stack shown in FIG. 2.

FIG. 3 shows a cross-sectional side view of the example piezoelectric die stack shown in FIG. 2. Thus, the reference numbers of FIGS. 2 and 3 coincide. The printhead substrate die 220 may be comprised of silicon, and may include fluidic passageways 227 through which ink is able to flow to and from the fluidics die layer via ink flow channels 225 within pedestal 240. The fluidic passageways 227 may lead to an ink reservoir on the other end.

The IC die layer is the second layer in die stack 200 and is positioned above the printhead substrate die 220. The IC die layer may be adhered to printhead substrate die 220 and may be narrower than printhead substrate die 220. In other words, the IC die 230 does not extend beyond the long edge of the printhead substrate 220. In some embodiments, the IC dies 230 of the IC die layer may also be shorter in length than the printhead substrate die 220. While not shown in FIG. 3, the IC dies 230 may also be longer than the printhead substrate die 220. The embodiments are not limited by these examples. The IC die layer may include multiple IC dies 230. FIGS. 2-3 illustrate two IC dies 230. At least one of the IC dies 230 includes a flex cable interface 275 that may be coupled with a flex cable 277 to receive input and drive signals. A flex cable may electrically couple the printhead assembly 102 with an IC die 230 to allow signals, power, and ground returns to reach each of the IC dies 230 and fluidics dies 250 via strategically placed wire bonds 255 and traces.

As is illustrated in FIGS. 2-3, the two IC dies 230 are separated from one another by pedestal 240. The IC dies 230 do not touch the sides of pedestal 240 so as to avoid potentially adverse heat transfer to the MEMS stack. This is illustrated by vertically oriented air gap 235. Typically, air gap 235 spans a few hundred microns and would be approximately the same for the IC dies 230 on both sides of pedestal 240.

The fluidic die layer in FIGS. 2-3 is shown as a single fluidics die 250 for illustrative purposes. In addition, not all the components that form a functioning fluidics die have been necessarily illustrated though a series of ink drops 260 emitted by the printhead have been illustrated. The fluidics die 250 sits atop pedestal 240 and may be bonded thereto via the aforementioned epoxy. Because the pedestal 240 is slightly taller than the IC dies 230, a space is created between the lower surface of the fluidic die 250 and the upper surface of the printhead substrate 220. The space is high enough to allow the IC dies 230 to be positioned beneath the fluidic die 250 such that the fluidic die 250 bottom surface does not touch the upper surfaces of the IC dies 230. A horizontally oriented air gap 237 is created between the fluidic die 250 bottom surface and the upper surfaces of the IC dies 230. This air gap 237 prevents potentially adverse heat transfer. Air gap 237 typically spans a distance of at least 100 microns to thermally isolate the IC dies 230 from the fluidic die 250.

Pedestal 240 is coupled on one end with the printhead substrate die 220 and on the other end with the fluidic die 250. Ink flow channels 225 may be disposed within pedestal component 240 and serve to transport ink between components within the fluidic die 250 through the fluidic passageways 227 disposed within the printhead substrate die 227 to an ink reservoir such as that shown as reference number 120 in FIG. 1.

To enhance the stability of die stack 200, a series of stand-offs 245 may be incorporated to provide additional support for the fluidics die 250. Photoimage-able polyimide or another photoresist may be a suitable pattern-able material for the stand-offs 245. The embodiments are not limited to these examples. In the embodiments of FIGS. 2-3, the stand-offs 245 may be strategically placed about the outer periphery of the lower surface of the fluidics die 250. The stand-offs 245 may extend downward until reaching the upper surface of IC dies 230. In this arrangement, the fluidics die 250 is supported by a combination of the pedestal 240 and the series of stand-offs 245. The embodiments are not limited to this example. Other embodiments may use shorter IC dies 230 and allow the stand-offs 245 to rest upon the top surface of the printhead substrate die 220.

FIGS. 2-3 present one embodiment that describes a die stack arrangement in which the IC dies 230 may be positioned under the fluidics dies 250 with the aid of a pedestal component 240. The remaining figures present alternative embodiments that also permit the IC dies 230 to be positioned under the fluidics dies 250 with the aid of a pedestal component 240.

It should also be noted that each IC die 230 could comprise two IC dies 230 that are butted end to end. This may be desirable in some circumstances because the yield of IC dies from a wafer may be higher for smaller dies.

Figure 4A:
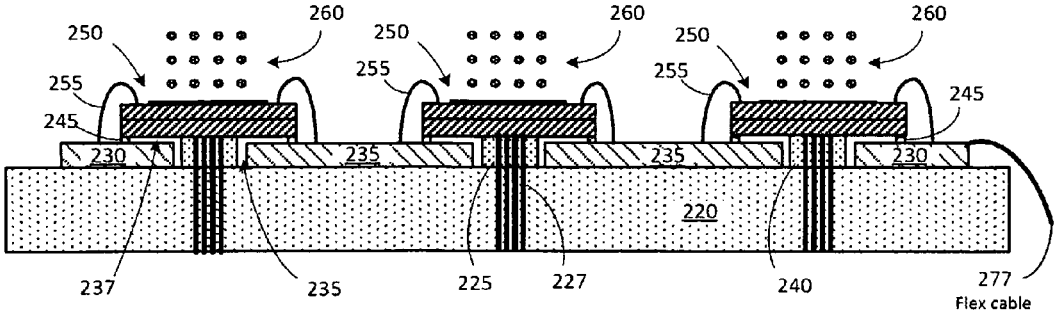
FIG. 4*a* shows a cross-sectional side view of an example piezoelectric die stack in a PIJ printhead that incorporates multiple integrated circuit (IC) designs, according to an embodiment.

FIG. 4*a* shows a cross-sectional side view of an example piezoelectric die stack in a PIJ printhead that incorporates multiple integrated circuit (IC) designs, according to an embodiment. In this embodiment, it is shown how multiple fluidics dies 250 can be integrated with multiple IC dies 230, 235 and made to operate in conjunction with one another. The elements and interconnections of FIG. 4*a* are similar to that of FIG. 3. One difference is that the IC dies 230, 235 are not necessarily the same size. Viewing FIG. 4*a*, the leftmost IC die 230 and the rightmost IC die 230 may be identical in size (e.g., width) while the inner IC dies 235 may be wider. IC dies 235, as illustrated, serve twice as many actuators as IC dies 230 accounting for the extra width. The extra width of IC die 235, however, need not be twice as much as IC die 230. The extra width may allow for enhanced functionality on IC dies 235 due to their larger overall size. The larger IC die size is directly attributable to the ability to position the IC dies 230, 235 under the fluidics dies 250 as has been described in great detail with reference to FIGS. 2-3.

The incorporation of pedestals 240 provide for significantly more surface area on the printhead substrate die 220 to be used for IC dies 230, 235. The IC dies 230, 235 may be electrically coupled to one another using wire bonds 255. The wire bonds 255 may pass signals from traces on the IC dies 230, 235 to traces on the fluidics dies 250. Because of the chained configuration of passing signals among the multiple IC dies 230, 235 and fluidics dies 250, only a single flex cable interface (e.g., FIG. 2, reference 275) may be required to drive an entire piezoelectric die stack regardless of the number of IC dies 230, 235 or fluidics dies 250. It is noted that the stand-offs 245 in this embodiment are arranged similarly to those in FIGS. 2-3.

Figure 4B:
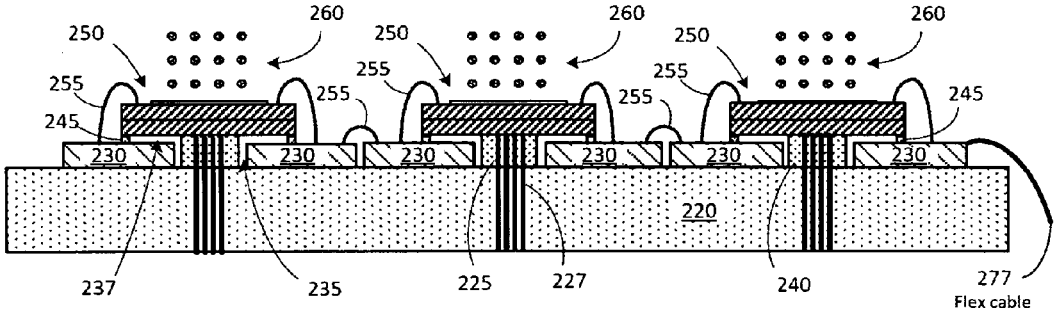
FIG. 4*b* shows a cross-sectional side view of an example piezoelectric die stack in a PIJ printhead that maintains a single IC design, according to an embodiment.

FIG. 4*b* shows a cross-sectional side view of an example piezoelectric die stack in a PIJ printhead that maintains a single IC design, according to an embodiment. In this embodiment, it is shown how multiple fluidics dies 250 can be integrated with multiple IC dies 230, and made to operate in conjunction with one another. The elements and interconnections of FIG. 4*b* are similar to that of FIG. 3. The difference between FIG. 4*a* and FIG. 4*b* is that the IC dies 230 may be identical throughout the IC die layer which adds an additional benefit in manufacturing efficiency. For purposes of wire bond 255 connections, the single IC may be rotated depending on which side of a pedestal 240 it is situated.

Just as in FIG. 4*a*, the incorporation of pedestals 240 provide for significantly more surface area on the printhead substrate die 220 to be used for IC dies 230. The IC dies 230 may be electrically coupled to one another using wire bonds 255. The wire bonds 255 may pass signals from traces on the IC dies 230 to traces on the fluidics dies 250. Because of the chained configuration of passing signals among the multiple IC dies 230 and fluidics dies 250, only a single flex cable interface (e.g., FIG. 2, reference 275) may be required to drive an entire piezoelectric die stack regardless of the number of IC dies 230 or fluidics dies 250. It is noted that the stand-offs 245 in this embodiment are also arranged similarly to those in FIGS. 2-3.

Figure 5:
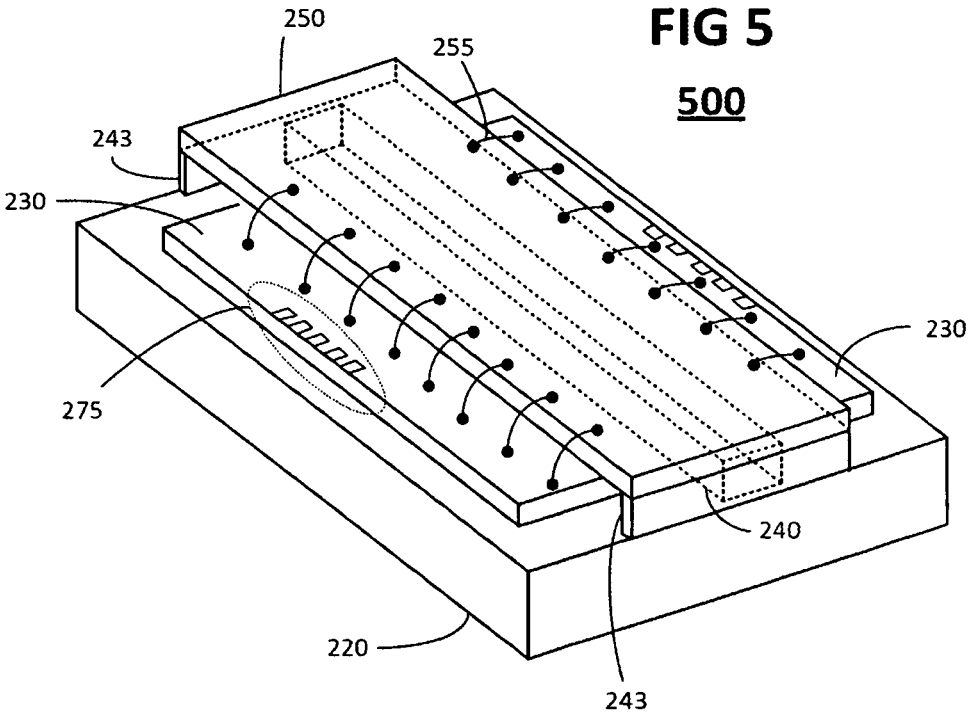
FIG. 5 shows a perspective view of an example piezoelectric die stack in a PIJ printhead, according to another embodiment.

FIG. 5 shows a perspective view of an example piezoelectric die stack 500 in a PIJ printhead, according to another embodiment. In general, the PIJ printhead 114 may include multiple die layers, each with different functionality. The layers in the die stack 500 may include a polymer printhead substrate die 220 layer, an IC die layer comprised of multiple IC dies 230, and a fluidics die 250 layer. Each layer in the die stack 200 may be typically formed of silicon. The layers may be bonded together using a chemically inert adhesive such as epoxy (not shown). A pedestal component 240 may set atop the printed substrate die 220. The pedestal component 240 may be molded into the polymer printhead substrate die 220 or may be a separate plastic, stainless steel or silicon part that is similarly adhered to the printhead substrate die 220. The embodiments are not limited to these examples.

Figure 6:
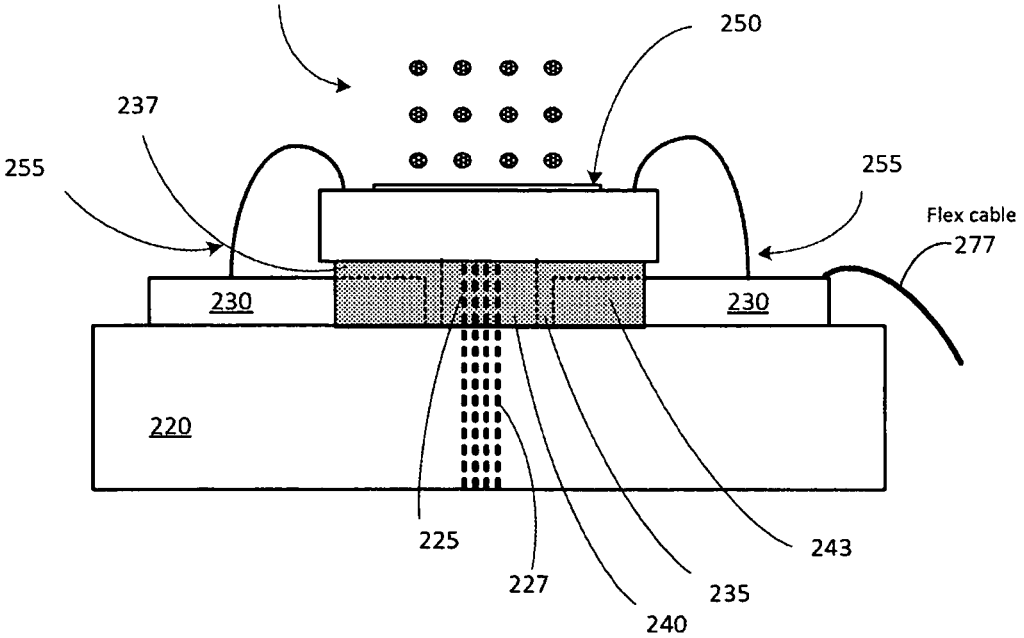
FIG. 6 shows a cross-sectional side view of the example piezoelectric die stack shown in FIG. 5.

FIG. 6 shows a cross-sectional side view of the example piezoelectric die stack 500 shown in FIG. 5. As previously described with reference to FIGS. 2-3, the printhead substrate die 220 may be comprised of silicon, and may include fluidic passageways 227 through which ink is able to flow to and from the fluidics die layer via ink flow channels 225 within pedestal 240. The fluidic passageways 227 may lead to an ink reservoir on the other end. In alternative embodiments, the printhead substrate die 220 may be comprised of ceramic or polymer. In some embodiments, a polymer printhead substrate die 220 may provide an advantageous high level of thermal isolation between the IC dies 230 and the MEMS stack.

The IC die layer is the second layer in die stack 500 and is positioned above the printhead substrate die 220. The IC die layer may be adhered to printhead substrate die 220 and may be narrower than printhead substrate die 220. In this embodiment, the IC dies 230 of the IC die layer are shorter in length than the printhead substrate die 220. The IC die layer may include multiple IC dies 230. FIGS. 5-6 illustrate two IC dies 230. One of the IC dies 230 includes a flex cable interface 275. A flex cable may electrically couple the printhead assembly 102 with an IC die 230 to allow signals, power, and ground returns to reach each of the IC dies 230 and fluidics dies 250 via strategically placed wire bonds 255 and traces.

As is illustrated in FIGS. 5-6, the two IC dies 230 are separated from one another by pedestal 240. The IC dies 230 do not touch the sides of pedestal 240 so as to avoid potentially adverse heat transfer. This is illustrated by vertically oriented air gap 235 in FIG. 6. Typically, air gap 235 spans a few hundred microns and would be approximately the same for the IC dies 230 on both sides of pedestal 240.

The fluidic die layer in FIGS. 5-6 is shown as a single fluidics die 250 for illustrative purposes. In addition, not all the components that form a functioning fluidics die have been necessarily illustrated though a series of ink drops 260 emitted by the printhead have been illustrated. The fluidics die 250 sits atop pedestal 240 and may be bonded thereto via the aforementioned epoxy. Because the pedestal 240 is slightly taller than the IC dies 230, a space is created between the lower surface of the fluidic die 250 and the upper surface of the printhead substrate 220. The space is high enough to allow the IC dies 230 to slide beneath the fluidic die 250 such that the fluidic die 250 bottom surface does not touch the upper surfaces of the IC dies 230. A horizontally oriented air gap 237 is created between the fluidic die 250 bottom surface and the upper surfaces of the IC dies 230. This air gap 237 prevents potentially adverse heat transfer. Air gap 237 typically spans a distance of at least 100 microns to thermally isolate the IC dies 230 from the fluidic die 250.

Pedestal 240 is coupled on one end with the printhead substrate die 220 and on the other end with the fluidic die 250. Ink flow channels 225 may be disposed within pedestal component 240 and serve to transport ink between components within the fluidic die 250 through the fluidic passageways 227 disposed within the printhead substrate die 227 to an ink reservoir such as that shown as reference number 120 in FIG. 1.

To enhance the stability of die stack 200, a pair of end supports 243 may be incorporated to provide additional support for the fluidics die 250. Photoimage-able polyimide or another photoresist may be a suitable pattern-able material for the end supports 243. The embodiments are not limited to these examples. In the embodiments of FIGS. 5-6, the stand-offs 245 may be placed at the ends of the lower surface of the fluidics die 250. The end supports 243 may extend downward until reaching the upper surface of the printhead substrate die 220. In this arrangement, the fluidics die 250 is supported by a combination of the pedestal 240 and the end supports 243. The end supports 243 do not rest on the IC dies 230 in this embodiment because the IC dies are shorter than the printhead substrate die 220. The embodiments are not limited to this example. Other embodiments may use longer IC dies 230 and allow the end supports 243 to rest upon the top surface of the IC dies 230.

Figure 7:
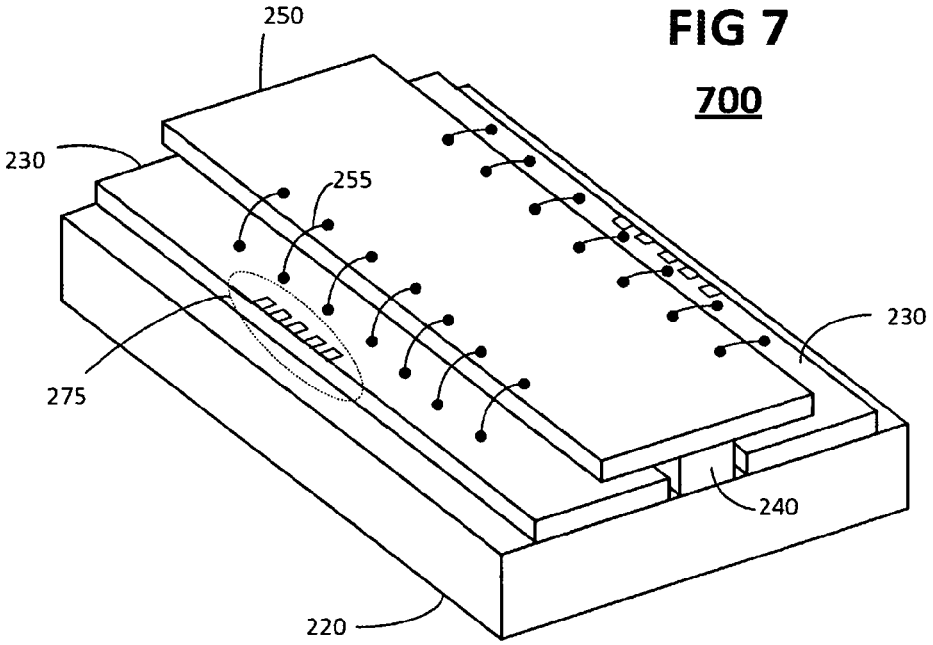
FIG. 7 shows a perspective view of an example piezoelectric die stack in a PIJ printhead, according to still another embodiment.

FIG. 7 shows a perspective view of an example piezoelectric die stack 700 in a PIJ printhead, according to still another embodiment. In general, the PIJ printhead 114 may include multiple die layers, each with different functionality. The layers in the die stack 700 may include a polymer printhead substrate die 220 layer, an IC die layer comprised of multiple IC dies 230, and a fluidics die 250 layer. Each layer in the die stack 200 may be typically formed of silicon. The layers may be bonded together using a chemically inert adhesive such as epoxy (not shown). A pedestal component 240 may set atop the printed substrate die 220. The pedestal component 240 may be molded into the polymer printhead substrate die 220 or may be a separate plastic, stainless steel or silicon part that is similarly adhered to the printhead substrate die 220. The embodiments are not limited to these examples.

Figure 8:
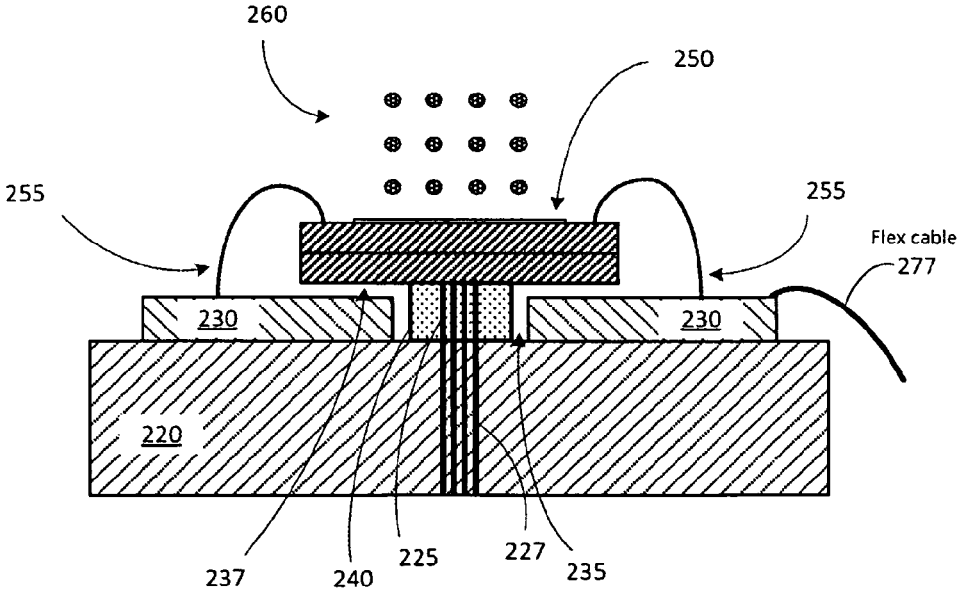
FIG. 8 shows a cross-sectional side view of the example piezoelectric die stack shown in FIG. 7.

FIG. 8 shows a cross-sectional side view of the example piezoelectric die stack 700 shown in FIG. 7. As previously described with reference to FIGS. 2-3, the printhead substrate die 220 may be comprised of silicon, and may include fluidic passageways 227 through which ink is able to flow to and from the fluidics die layer via ink flow channels 225 within pedestal 240. The fluidic passageways 227 may lead to an ink reservoir on the other end.

The IC die layer is the second layer in die stack 700 and is positioned above the printhead substrate die 220. The IC die layer may be adhered to printhead substrate die 220 and may be narrower than printhead substrate die 220. The IC die layer may include multiple IC dies 230. FIGS. 7-8 illustrate two IC dies 230. One of the IC dies 230 includes a flex cable interface 275. A flex cable may electrically couple the printhead assembly 102 with an IC die 230 to allow signals, power, and ground returns to reach each of the IC dies 230 and fluidics dies 250 via strategically placed wire bonds 255 and traces.

As is illustrated in FIGS. 7-8, the two IC dies 230 are separated from one another by pedestal 240. The IC dies 230 do not touch the sides of pedestal 240 so as to avoid potentially adverse heat transfer. This is illustrated by vertically oriented air gap 235. Typically, air gap 235 spans a few hundred microns and would be approximately the same for the IC dies 230 on both sides of pedestal 240.

The fluidic die layer in FIGS. 7-8 is shown as a single fluidics die 250 for illustrative purposes. In addition, not all the components that form a functioning fluidics die have been necessarily illustrated though a series of ink drops 260 emitted by the printhead have been illustrated. The fluidics die 250 sits atop pedestal 240 and may be bonded thereto via the aforementioned epoxy. Because the pedestal 240 is slightly taller than the IC dies 230, a space is created between the lower surface of the fluidic die 250 and the upper surface of the printhead substrate 220. The space is high enough to allow the IC dies 230 to be positioned beneath the fluidic die 250 such that the fluidic die 250 bottom surface does not touch the upper surfaces of the IC dies 230. A horizontally oriented air gap 237 is created between the fluidic die 250 bottom surface and the upper surfaces of the IC dies 230. This air gap 237 prevents potentially adverse heat transfer. Air gap 237 typically spans a distance of at least 100 microns to thermally isolate the IC dies 230 from the fluidic die 250.

Pedestal 240 is coupled on one end with the printhead substrate die 220 and on the other end with the fluidic die 250. Ink flow channels 225 may be disposed within pedestal component 240 and serve to transport ink between components within the fluidic die 250 through the fluidic passageways 227 disposed within the printhead substrate die 227 to an ink reservoir such as that shown as reference number 120 in FIG. 1.

In this embodiment there are no stand-offs to help support the fluidics die 250. The bonding between the pedestal 240 and the printhead substrate 220 as well as the bonding between the pedestal 240 and the fluidics die 250 keep the fluidics die 250 in position above the IC dies 230. The pedestal 240 may be molded into the polymer printhead substrate die 220 or may be a separate plastic, stainless steel or silicon part that is similarly adhered to the printhead substrate die 220. The embodiments are not limited to these examples.

Figure 9A:
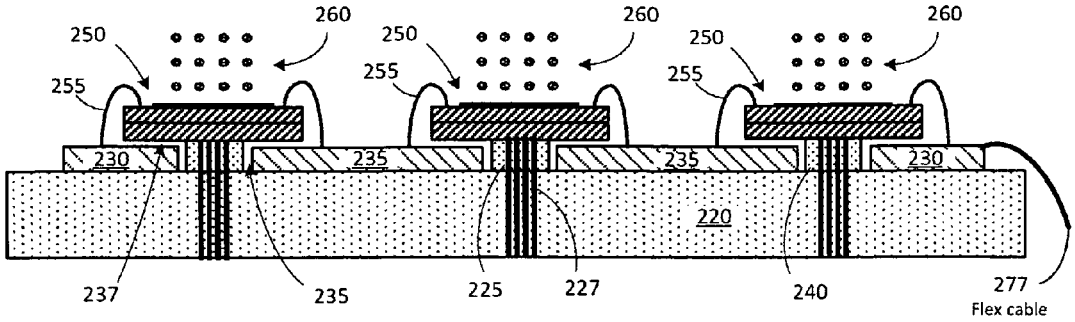
FIG. 9*a* shows a cross-sectional side view of an example piezoelectric die stack in a PIJ printhead that incorporates multiple integrated circuit (IC) designs, according to another embodiment.

FIG. 9*a* shows a cross-sectional side view of an example piezoelectric die stack in a PIJ printhead that incorporates multiple integrated circuit (IC) designs, according to an embodiment. In this embodiment, it is shown how multiple fluidics dies 250 can be integrated with multiple IC dies 230, 235 and made to operate in conjunction with one another. The elements and interconnections of FIG. 4*a* are similar to that of FIG. 3. One difference is that the IC dies 230, 235 are not necessarily the same size. Viewing FIG. 9*a*, the leftmost IC die 230 and the rightmost IC die 230 may be identical in size (e.g., width) while the inner IC dies 235 may be wider. This may allow for enhanced functionality on IC dies 235 due to their larger overall size. The larger IC die size is directly attributable to the ability to position the IC dies 230, 235 under the fluidics dies 250 as has been described in great detail with reference to FIGS. 2-3.

The incorporation of pedestals 240 provide for significantly more surface area on the printhead substrate die 220 to be used for IC dies 230, 235. The IC dies 230, 235 may be electrically coupled to one another using wire bonds 255. The wire bonds 255 may pass signals from traces on the IC dies 230, 235 to traces on the fluidics dies 250. Because of the chained configuration of passing signals among the multiple IC dies 230, 235 and fluidics dies 250, only a single flex cable interface (e.g., FIG. 2, reference 275) may be required to drive an entire piezoelectric die stack regardless of the number of IC dies 230, 235 or fluidics dies 250. It is noted that there are no stand-offs in this embodiment.

Figure 9B:
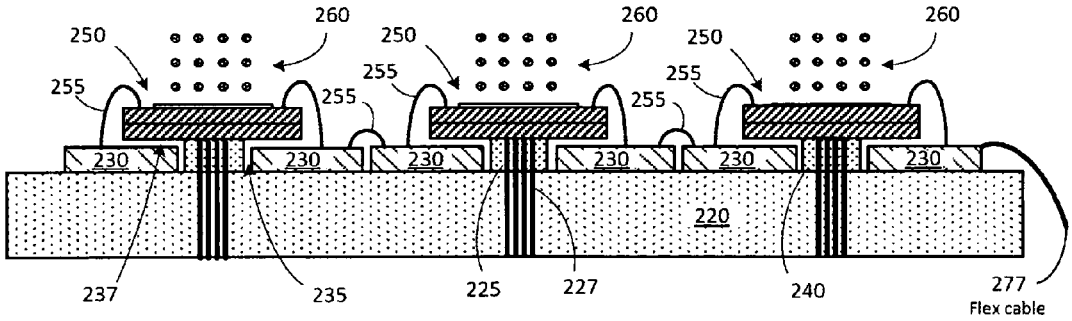
FIG. 9*b* shows a cross-sectional side view of an example piezoelectric die stack in a PIJ printhead that maintains a single IC design, according to another embodiment.

FIG. 9*b* shows a cross-sectional side view of an example piezoelectric die stack in a PIJ printhead that maintains a single IC design, according to an embodiment. In this embodiment, it is shown how multiple fluidics dies 250 can be integrated with multiple IC dies 230, and made to operate in conjunction with one another. The elements and interconnections of FIG. 9*b* are similar to that of FIG. 8. The difference between FIG. 9*a* and FIG. 9*b* is that the IC dies 230 may be identical throughout the IC die layer which adds an additional benefit in manufacturing efficiency. For purposes of wire bond 255 connections, the single IC may be rotated depending on which side of a pedestal 240 it is situated.

Just as in FIG. 9*a*, the incorporation of pedestals 240 provides for significantly more surface area on the printhead substrate die 220 to be used for IC dies 230. The IC dies 230 may be electrically coupled to one another using wire bonds 255. The wire bonds 255 may pass signals from traces on the IC dies 230 to traces on the fluidics dies 250. Because of the chained configuration of passing signals among the multiple IC dies 230 and fluidics dies 250, only a single flex cable interface (e.g., FIG. 2, reference 275) may be required to drive an entire piezoelectric die stack regardless of the number of IC dies 230 or fluidics dies 250. It is noted that there are no stand-offs in this embodiment.

Figure 10:
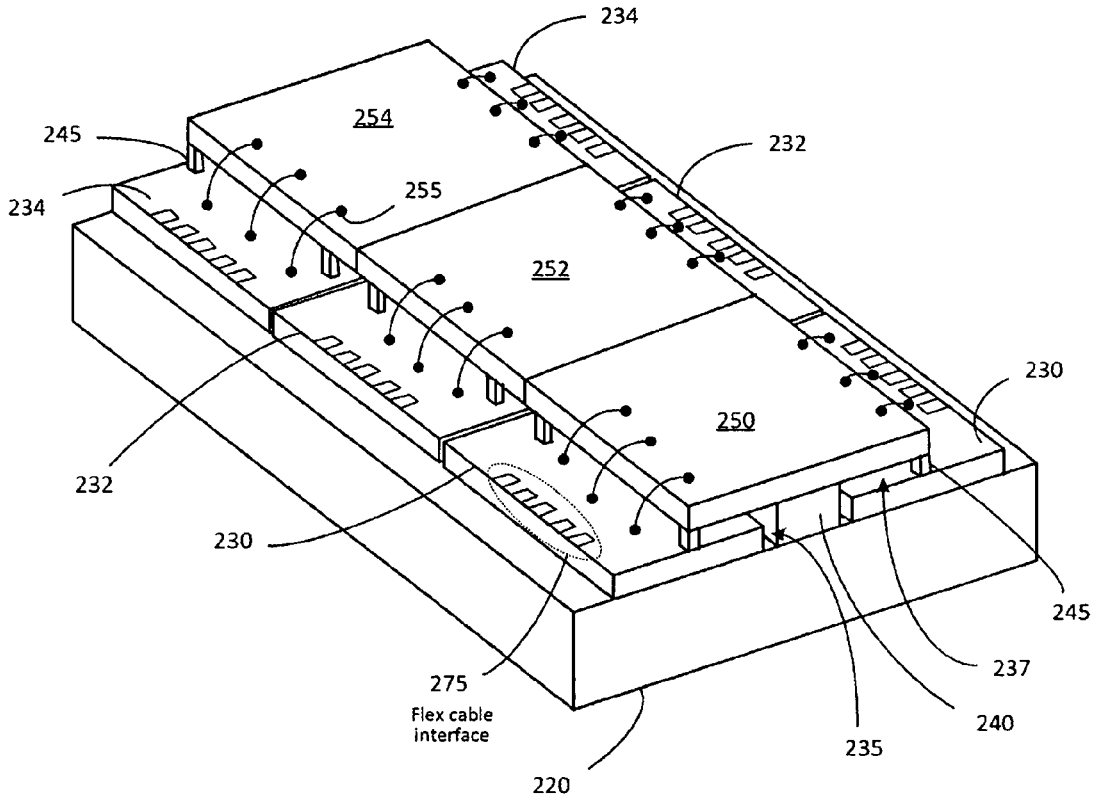
FIG. 10 shows a perspective view of an example piezoelectric die stack in a PIJ printhead, according to another embodiment.

FIG. 10 shows a perspective view of an example piezoelectric die stack 200 in a PIJ printhead 114, according to an embodiment of the disclosure. This embodiment is similar to that shown in FIG. 2. In this embodiment, however, there are multiple discrete configurations of IC dies and fluidics dies positioned on the printhead substrate die 220.

In the embodiment illustrated in FIG. 10, a first configuration may be comprised of IC dies 230 and fluidics die 250. A second configuration may be comprised of IC dies 232 and fluidics die 252. A third configuration may be comprised of IC dies 234 and fluidics die 254. The three configurations illustrated may be arranged in a substantially lengthwise array. Configurations such as this may be up to several meters in length and may be desirable for large format printers. While FIG. 10 illustrates three (3) configurations, many more may be included on a printhead substrate die 220. The embodiments are not limited to this example.

In an alternative embodiment, the dies for each configuration may take the shape of a parallelogram and each configuration may be slightly offset both vertically and horizontally from its adjacent configuration while not actually contacting its adjacent configuration. This allows for tolerances in pick and place die handling equipment. Typically all dies (e.g., IC and fluidic) may be placed with a positional accuracy of ±10 μm. The vertical and horizontal offsets ensure there is no discontinuity in horizontal spacing for nozzles since nozzles cannot easily be located sufficiently close to the edge of a die for zero offset.

In another embodiment, narrow ribs may protrude from the sides of the pedestal to ensure the IC dies do not touch a substantial portion of the pedestal. Another example may be for the pedestal to be fabricated of a low thermally conductive material with the narrow edge of the dies touching the sides of the pedestal.

Some embodiments may be described using the expression "one embodiment" or "an embodiment" along with their derivatives. These terms mean that a particular feature, structure, or characteristic described in connection with the embodiment is included in at least one embodiment. The appearances of the phrase "in one embodiment" in various places in the specification are not necessarily all referring to the same embodiment. Further, some embodiments may be described using the expression "coupled" and "connected" along with their derivatives. These terms are not necessarily intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

It is emphasized that the Abstract of the Disclosure is provided to allow a reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment. In the appended claims, the terms "including" and "in which" are used as the plain-English equivalents of the respective terms "comprising" and "wherein," respectively. Moreover, the terms "first," "second," "third," and so forth, are used merely as labels, and are not intended to impose numerical requirements on their objects.

What has been described above includes examples of the disclosed architecture. It is, of course, not possible to describe every conceivable combination of components and/or methodologies, but one of ordinary skill in the art may recognize that many further combinations and permutations are possible. Accordingly, the novel architecture is intended to embrace all such alterations, modifications and variations that fall within the spirit and scope of the appended claims.

What is claimed is:

1. A piezoelectric inkjet die stack comprising:

a printhead substrate die;

at least one pedestal seated on the printhead substrate die, the at least one pedestal including ink flow channels disposed within;

a fluidics die seated atop the pedestal; and at least one integrated circuit (IC) die seated on the printhead substrate die, the at least one IC die positioned substantially but not completely beneath the fluidics die and positioned on either side of the at least one pedestal such that air gaps exist between a top surface of the at least one IC die and a bottom surface of the fluidics die and between the at least one IC die and the at least one pedestal.

2. The piezoelectric inkjet die stack of claim 1, further comprising a plurality of stand-offs to support the fluidics die above the at least one IC die.

3. The piezoelectric inkjet die stack of claim 2, the stand-offs extending from the top surface of the at least one IC die to the bottom surface of the fluidics die.

4. The piezoelectric inkjet die stack of claim 2, the stand-offs extending from a top surface of the printhead substrate die to the bottom surface of the fluidics die.

5. The piezoelectric inkjet die stack of claim 2, the stand-offs comprising a photoimage-able polyimide.

6. The piezoelectric inkjet die stack of claim 1, further comprising a pair of end supports to support the fluidics die above the at least one IC die, each end support:

spanning substantially a width of the fluidics die;

attached at one edge to the fluidics die; and attached at another edge to the printed substrate die.

7. The piezoelectric inkjet die stack of claim 1, when there are multiple IC dies, the IC dies are not all identical.

8. The piezoelectric inkjet die stack of claim 1, when there are multiple IC dies, the IC dies are all identical.

9. The piezoelectric inkjet die stack of claim 1 in which the air gap between the IC dies and the fluidics die spans approximately 100 microns.

10. The piezoelectric inkjet die stack of claim 1 in which the air gap between the at least one IC die and the pedestal spans approximately 100 microns.

11. The piezoelectric inkjet die stack of claim 1, the width of the at least one IC die extends beyond the fluidic die by at least 500 microns.

12. The piezoelectric inkjet die stack of claim 1, when there are multiple IC dies, at least one of the IC dies includes a flex cable interface.

13. The piezoelectric inkjet die stack of claim 12, further comprising wire bonds electrically coupling traces on the at least one IC die and the fluidics die.

14. The piezoelectric inkjet die stack of claim 1, the pedestal comprising one of a plastic, stainless steel, or silicon material.

15. The piezoelectric inkjet die stack of claim 1, the at least one pedestal molded with the printhead substrate die.

16. A piezoelectric inkjet die stack comprising:

a printhead substrate die;

multiple configurations, each configuration comprising:

a pedestal seated on the printhead substrate die, the pedestal including ink flow channels disposed within;

a fluidics die seated atop the pedestal; and at least one integrated circuit (IC) die seated on the printhead substrate die, the at least one IC die positioned substantially but not completely beneath the fluidics die and positioned on either side of the pedestal such that air gaps exist between a top surface of the at least one IC die and a bottom surface of the fluidics die and between the at least one IC die and the pedestal, wherein the configurations are positioned in a substantially end to end lengthwise array on the printhead substrate die.

17. A piezoelectric inkjet die stack comprising:

a printhead substrate die;

multiple pedestals seated on the substrate die, the pedestals including ink flow channels disposed within;

multiple fluidics dies, each fluidics die seated atop a corresponding pedestal; and multiple integrated circuit (IC) dies seated on the printhead substrate die, the IC dies arranged to be positioned substantially but not completely beneath the fluidics dies and positioned to the sides of the pedestals such that air gaps exist between top surfaces of the IC dies and bottom surfaces of the fluidics dies and between the IC dies and the pedestals.

18. The piezoelectric inkjet die stack of claim 17, further comprising a plurality of stand-offs to support the fluidics die above the IC dies.

19. The piezoelectric inkjet die stack of claim 17, at least one of the IC dies including a flex cable interface.

20. The piezoelectric inkjet die stack of claim 19, further comprising wire bonds electrically coupling traces on the IC dies and the fluidics die.

* * * * *